United States Patent [19]

Sato et al.

[11] 4,057,978

[45] Nov. 15, 1977

[54] APPARATUS FOR COOLING PELLETS

[75] Inventors: Yoshimasa Sato; Toshio Tsukuda, both of Niihama; Hajime Inoue, Abiko; Akio Mutsuta, Wakayama, all of Japan

[73] Assignees: Sumitomo Heavy Industries, Ltd., Tokyo; Sumitomo Metal Industries, Ltd., Osaka, both of Japan

[21] Appl. No.: 658,364

[22] Filed: Feb. 17, 1976

[51] Int. Cl.[2] ..... F25D 23/12

[52] U.S. Cl. ..... 62/331; 62/374; 98/115 R; 110/165 R; 266/158; 266/159; 432/72

[58] Field of Search ..... 62/62, 63, 64, 100, 62/268, 270, 373, 374, 375, 331; 98/115 R; 432/72; 110/165 R; 266/158, 159

[56] References Cited

U.S. PATENT DOCUMENTS

| | | | |
|---|---|---|---|
| 2,787,141 | 2/1957 | Julius | 62/64 |
| 2,983,234 | 5/1961 | Reilly | 110/165 R |
| 3,036,440 | 5/1962 | Feinman | 62/64 |
| 3,826,100 | 7/1974 | Vahl | 62/63 |

*Primary Examiner*—Ronald C. Capossela
*Attorney, Agent, or Firm*—Kurt Kelman

[57] ABSTRACT

An improved apparatus for cooling hot pellets discharged from a kiln or the like with water is presented wherein the pellets are charged through a chute into a water cooling bath while avoiding oxidation thereof. The cooling bath is covered with a hood and the pressure difference between the chute and hood is controlled during the process.

6 Claims, 3 Drawing Figures

APPARATUS FOR COOLING PELLETS

FIELD OF INVENTION

The invention relates to an apparatus for cooling hot pellets with water.

BACKGROUND OF INVENTION:

It has been customary to employ air to cool hot pellets discharged from a rotary kiln or the like within a reduced atmosphere or to indirectly air cool the same within a sealed container when it is necessary to avoid oxidation of the pellets. However, in either of the air cooling processes referred to above, the cooling efficiency is not satisfactory and oxidation also may be encountered during the cooling process. Further, a large apparatus is required for air cooling due to its low efficiency and, accordingly, it requires a large installation area and consumes much power thereby making it uneconomical.

Thus, it has also been proposed to apply a water spray as cooling medium for the hot pellets. Such a water cooling apparatus generates a large volume of vapor which makes it impracticable to dispose the apparatus coupled in series with a rotary kiln or the like, since the treatment of such volume of vapor is difficult. Therefore, the pellets are likely to be oxidized in the course of being cooled. Further, these days, if such vapor is exhausted into the open air through a chimney of the plant, it becomes white smoke likely to cause complaints about the environmental pollution.

Also, if it is attempted to connect the water cooling apparatus with the kiln or the like, the generated vapor may get into the inside of the kiln whereby the firebricks of the kiln may be degraded or damaged and the life of the kiln is shortened.

SUMMARY OF INVENTION

Thus, it is an object of the invention to provide an apparatus using water as a cooling medium but free of the drawbacks above.

It is a further object of the invention to provide an apparatus for cooling burned pellets with water, utilizing pressure balance or difference in the apparatus and excess heat in the kiln in order to dissipate the discharge of vapor which is the problem in the water cooling system.

It is also an object to provide an apparatus for water cooling the burned pellets economically and with high efficiency.

According to the present invention, it is proposed to employ a water cooler or cooling apparatus in order to rapidly cool the hot pellets while avoiding oxidation thereof wherein the generated vapor is controlled under pressure so as not to enter the kiln and is injected into that portion of the kiln where the temperature is relatively high, thereby lowering the concentration of the vapor by diffusion and preventing the vapor from becoming white smoke.

The invention will further be clarified by the description in combination with the accompanying drawings.

BRIEF EXPLANATION OF DRAWINGS

Reference is now made to the drawings wherein.

DETAILED DESCRIPTION OF INVENTION

Figure 1:
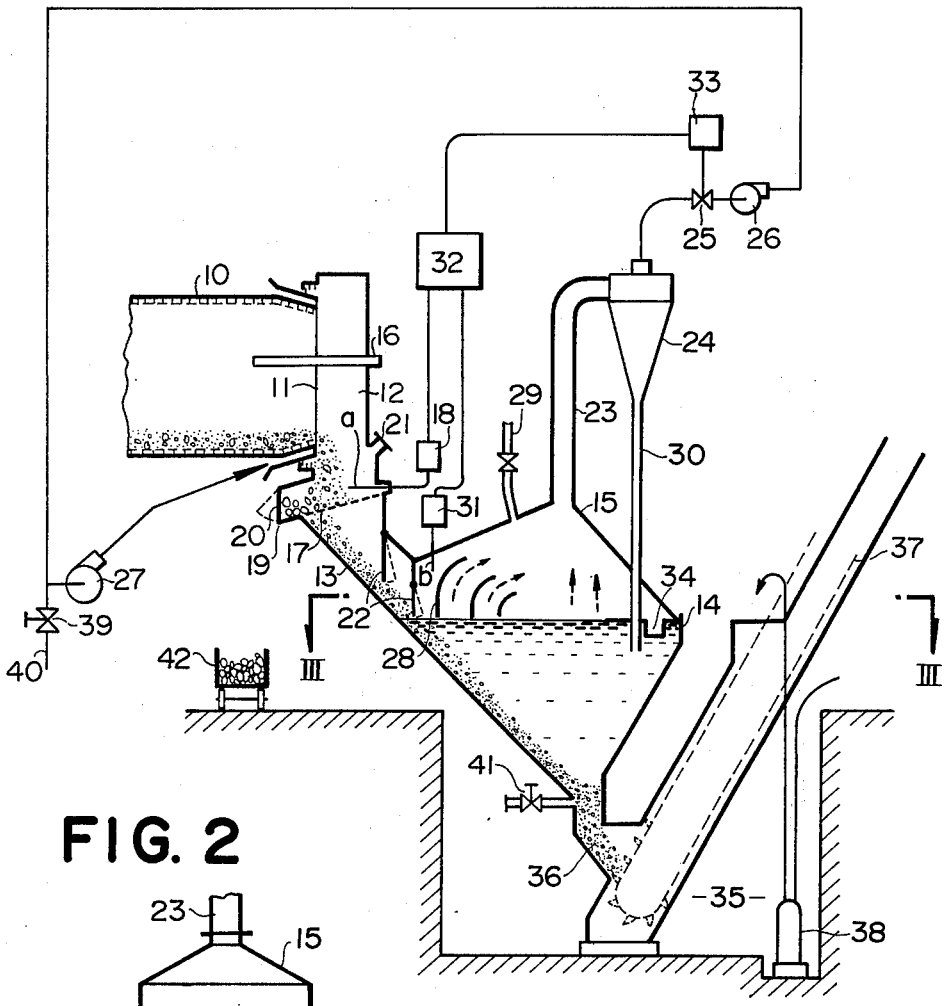
FIG. 1 is a schematic illustration of the cooling apparatus according to the present invention.
Figure 2:
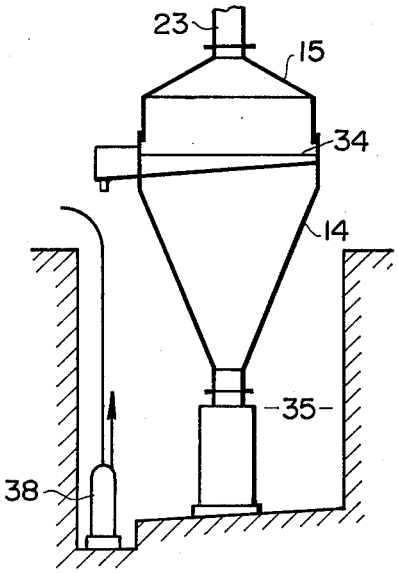
FIG. 2 is a partial side view of the apparatus shown in FIG. 1.
Figure 3:
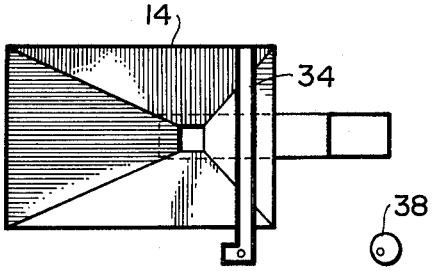
FIG. 3 is a partial plan view of the apparatus shown in FIG. 1 as viewed in section indicated by III — III.

Referring to the drawings, particularly to FIG. 1, there is shown a schematic illustration of the whole system of the present invention. In the illustrated embodiment, an end of a rotary kiln 10 is shown in the left hand of FIG. 1. Pellets processed by the kiln 10 are discharged from a discharge opening 11 of the kiln into a discharge chute 12 disposed at the discharge side of the kiln 10. The upper portion of the discharge chute 12 is arranged to cover the discharge opening of the kiln 10 and the lower end of the chute 12 is in communication with cooling bath 14 through a slide passage 13. Further, the chute 12 is also connected to a hood 15 through a side plate of the chute. At the end of the kiln, there is disposed a burner 16 which extends into the kiln through the chute 12 and is adapted to heat the pellets. Within the chute 12, a grate or grizzly 17 is disposed to pass pellets of suitable size therethrough and retain large clinkers which might have been produced due to to insufficient burning within the kiln. To remove these clinkers accumulated in the neighborhood of the grizzly 17, a discharge opening 19 is provided at a suitable place adjacent the grizzly 17, the opening 19 being normally closed by a discharge door 20 which is occasionally opened to discharge the clinkers. The quantity of clinkers accumulated may be monitored, for example, by looking through an inspection window 21 provided at an appropriate place, such as over the grizzly 17.

In the slide passage 13 which is at the lower portion of the discharge chute 12, adjustable gates 22 are provided so as to prevent vapor or air (coming from cooling bath 14) from being introduced into the chute 12. Each of the gates is preferably attached to the inner wall of the chute at the upper end thereof through a hinge pin (not shown) so that the extent of the opening of the passage 13 is optionally regulated by moving the hinged gate 22. While the drawing shows gate means consisting of two gates 22, it is, of course, possible to arrange a single gate or more than the two gates.

The upper end of the hood 15 is connected to a cooling fan 27 through an exhaust duct 23, a dust collector 24 disposed in the duct 23, an exhaust regulating damper 25 and a suction fan 26, the cooling fan 27 being arranged to cool the discharge end of the kiln 10 sucking fresh air through a valve 39 and an intake pipe 40. By the arrangement above, the vapor and/or dust generated upon charging the hot pellets into the cooling bath 14 may be directed upwardly to the duct 23 through guide vanes 28 mounted within the hood 15. Also, a water supply pipe 29 is in communication with the upper portion of the hood through an appropriate valve means so as to spray cold water in order to cool the generated vapor and to condense it partially to return it to the water bath as well as to urge the dust contained in the vpor into the cooling bath 14. Accordingly, the exhaust gas (containing the vapor) is partially cleaned by the water spray and, thence, directed to the dust collector 24 through the duct 23. The gas thus cleaned is then blown to the discharge end of the kiln 10 by means of the cooling fan 27. On the other hand, the dust collected at the collector 24 is discharged into the cooling bath 14 through a conduit 30.

The damper 25 is arranged to regulate the pressure difference between the discharge chute 12 and the space in the hood 15 so that the absolute value of the negative pressure within the hood 15 is always higher than that within the chute 12. In order to automatically maintain the pressure difference in the condition as above, pressure gauges 18 and 31 may be provided so that their respective probes are disposed in the portion "*a*" within the chute 12 and in the portion "*b*" within the hood 15 adjacent the chute 12, respectively. Each of the gauges 18 and 31 is coupled with a differential pressure detector 32 which is adapted to deliver its output signal to an actuator 33. The actuator 33 controls the opening degree of the damper 25 in accordance with the difference in pressure detected by the pressure detector 32 to maintain the pressure difference within a desired range.

The water in the bath 14 is vaporized in the process of cooling the hot pellets; however, the water spray supplied through pipe 29 compensates for the amount of water spent as vapor so that a certain level of water in the bath 14 is always maintained. Also, the water thus sprayed serves to suppress the rising temperature of the water in the bath. Further, there is provided an overflow duct 34 at an appropriate level to discharge excess water as well as floating dust, residual carbons or the like into a pit 35.

The cooling bath 14 is preferably funnel-shaped and, at the lower end thereof, there is disposed a discharge opening 36 through which cooled pellets are discharged. In order to deliver the pellets discharged from the opening 36, it is preferable to provide a conveyor 37 which conveys the pellets to the next stage, for example, a sorting sieve device (not shown). In this conveyor, there are a plurality of buckets so as to receive the pellets therein and deliver the same upwardly. In each of the buckets, a suitable number of perforations are provided so that water is drained therethrough during the upward movement of the conveyor or buckets.

Within the pit 35, a submergible pump 38 is disposed to feed the overflown materials such as excess water, dusts, charcoal, cokes or the like discharged from the overflow duct 34 to the conveyor 37 which conveys those together with the pellets to the sorting sieve device where the delivered materials except for the pellets are recovered by the sieve device and re-utilized by being mixed with raw materials for producing the pellets.

In FIG. 1, there is illustrated a cart 42. This cart is intended to deliver the clinkers discharged from the discharge door 20. Also, in the lower end of the bath 14, there is provided an air injecting pipe 41 provided with a valve and opening to the interior of the bath. This pipe 41 serves to inject air into the bath so that the water near opening 36 is agitated thereby preventing the opening from being clogged by the pellets and/or dust.

Since discharge chute 12 is shielded from the ambient air and vapor coming from cooling bath 14 the pellets discharged from the kiln are maintained in a non-oxidizing atmosphere as they are charged into the cooling bath through the discharge chute whereby the hot pellets are rapidly cooled within being subjected to oxidation. Also, most of the vapor generated in the bath is condensed to water by the cooling effect of the sprayed water and the exhaust gas containing the rest of the vapor, dust and so on is cleaned and blown onto the discharge end of the kiln where the vapor is diffused together with air supplied through the valve 39 and the pipe 40 and heated by the discharge end of the kiln whereby the vapor is prevented from reaching the dew point and, thus the vapor may not become white smoke and is discharged into the open air without causing any pollution problem.

In the operation according to the present invention, the following data is obtained regarding the pressure difference between the points "*a*" and "*b*".

The damper 25 was regulated to set the difference as "10 mm Aq" at the detector 22 with aiming to maintain the pressure values of "*a*" and "*b*" as "350 mm Aq" and "−10 mm Aq", respectively and to control the pressure variation at the point "*a*" within the range of "−10 mm Aq ~ +10 mm Aq". According to the observation in this example, the pressure at the point "*b*" well followed the variation of the pressure at the point "*a*" to the extent between "−20 mm Aq ~ 0 mm Aq".

The invention has been explained in detail with reference to the particular embodiment presented. However, it is noted that the invention may be modified within the spirit and scope of the invention which will be defined in the appended claims.

What is claimed is:

1. An apparatus for cooling hot pellets with water, which comprises the combination of a. a furnace for producing the hot pellets and having a discharge opening for the hot pellets,
b. a discharge chute for the hot pellets, one end of the chute being coupled to the discharge opening and the discharge chute being shielded from the air so as to maintain a non-oxidizing atmosphere in the chute,
c. a cooling bath containing cooling water, the other end of the discharge chute being in communication with the cooling bath whereby the hot pellets are received in the cooling bath from the discharge opening of the furnace through the shielded chute, cooling of the hot pellets in the cooling bath generating vapor,
d. a hood mounted over and covering the cooling bath for gathering the vapor,
e. a gate means at the other end of the discharge chute and arranged to prevent substantial entry of vapor and air from the hood into the chute,
f. an exhaust duct connected to the hood for discharging the vapor therefrom,
g. a regulating damper coupled with the exhaust duct for regulating the amount of vapor and air to be exhausted from the hood through the duct,
h. a means for detecting pressure difference between the chute and the hood, and
i. a means for actuating the damper so as to maintain the pressure in the hood lower than that in the chute in response to the pressure difference detecting means.

2. The apparatus of claim 1, further comprising a cooling fan arranged to receive the vapor from the exhaust duct and to blow the vapor and fresh air towards the discharge opening of the furnace to cool the discharge opening.

3. The apparatus of claim 1, further comprising water spray means arranged to direct a water spray into the hood.

4. The apparatus of claim 1, wherein the pressure difference detecting means comprises a first pressure sensing means for sensing the pressure within the chute, a second pressure sensing means for sensing the pressure within the hood, and means for comparing the sensed pressures and for transmitting a resultant comparison signal to the actuating means for the damper.

5. The apparatus of claim 1, further comprising a dust collector disposed in the exhaust duct for returning the collected dust to the cooling bath.

6. The apparatus of claim 1, further comprising a grating means in the other end of the chute for eliminating clinkers discharged from the furnace with the pellets.

* * * * *